United States Patent [19]

Warehime

[11] 4,339,133

[45] Jul. 13, 1982

[54] MALLET DRIVEN SLIDING DISC GAME AND APPARATUS

[76] Inventor: Norwood R. Warehime, 704 W. 34th St., Baltimore, Md. 21211

[21] Appl. No.: 187,536

[22] Filed: Sep. 15, 1980

[51] Int. Cl.[3] ..... A63F 3/00

[52] U.S. Cl. ..... 273/126 R; 273/128 R; 273/129 K

[58] Field of Search ..... 273/126 R, 128 R, 85 R, 273/129 K, 67 R, 83, 56, 129 L; 272/3

[56] References Cited

U.S. PATENT DOCUMENTS

| | | | |
|---|---|---|---|
| 951,805 | 3/1910 | Eldridge | 273/126 R |
| 1,856,117 | 5/1932 | Small, Jr. | 273/3 R |
| 2,878,023 | 3/1959 | Decepoli | 273/128 R |
| 3,425,696 | 2/1969 | Dockum | 273/126 R |
| 3,913,918 | 10/1975 | Trachtman | 273/126 R |
| 4,000,900 | 1/1977 | Léhmann | 273/128 R |

*Primary Examiner*—Richard C. Pinkham
*Assistant Examiner*—T. Brown

[57] ABSTRACT

The invention provides a set of five sliding disc game pieces and croquet type striking mallet for use in novel game play on a smooth and horizontal low friction type surface such as ice. Game apparatus design considers desirable range of disc diameter, height, weight, and weight distribution, and also shows an improved head end design of striking mallet for better access and alignment possibilities in game play. Novel discs have diameters comparable to those of discs for shuffleboard play, but are greater in height, are more pliable, and are designed with lower center of gravity in preferred embodiments. Striking mallet head is flat on bottom and has square transverse cross section design which tapers downwardly and inwardly toward end faces. A center guide line extends across the top of mallet head and down end faces. Mallet face height is approximately same as disc height for good center-to-center type contact in game play. Game play is slow moving type, for singles or doubles, involving skill and strategy striking and placing of discs with mallet for combination of contact and proximity score points. Game can also be played on other smooth and horizontal surfaces such as concrete, asphalt, wood, tile, and terrazzo.

10 Claims, 14 Drawing Figures

MALLET DRIVEN SLIDING DISC GAME AND APPARATUS

DESCRIPTION

1. Technical Field

The invention relates to a mallet driven sliding disc game and apparatus; resilient game discs and croquet type mallets, each of appropriate size and construction, are used in game play on ice, or any other suitable smooth and horizontal playing surface with low friction characteristics, whereby players drive their discs with mallets for game advantage and maximum contact and proximity point scores.

2. Background Art

Mallets for subject novel game are somewhat similar to those used in high level croquet competition. The general croquet catalogue issued by John Jaques & Sons Ltd. of England shows high quality mallets with heads measuring 3×3×9 inches (7.6×7.6×22.9 cms), made of hardwood, with square transverse cross section. Cited mallets also have a center sight line running longitudinally across the top side of head, and have metal banding at mallet head ends for strengthening. Subject novel mallets differ from cited mallets with the former having tapering of transverse cross section of head from center to ends in order to provide better alignment and lateral clearance in the general area of contact when mallet strikes game disc. For reference note, the height (diameter) of a regulation croquet ball is 3⅝ inches (9.2 cms), and it weighs about 1.0 pound (454 gms). It should also be noted that the weight of a croquet ball is about the upper limit weight range of subject novel game discs. Thus the novel tapering game mallet should be capable of making a mallet strike on a game disc with a force somewhat similar to that of cited mallet making a strike on a croquet ball.

In the assessment of background art of sliding game discs, it is obvious that discs for curling and eisstock are too large in size and too heavy in weight for use in novel subject game, and discs for hockey and board and table games are too small in size and weight. Game discs for regular shuffleboard are in the desired diameter range for use in novel subject game but are too low in height for proper striking with mallet. Furthermore, current shuffleboard disc construction material is too hard, and tends to damage face of mallet when struck.

DISCLOSURE OF INVENTION

The invention as claimed is intended to provide a set of sliding disc game pieces and croquet type mallet suitable for use in novel game play on a smooth and horizontal low friction type surface such as ice. It solves the problem of: (a) how to design a sliding disc within a desired range of disc diameter, height, weight, and weight distribution; (b) how to design a croquet type striking mallet with lower and smaller than normal head end faces which provides better alignment and lateral clearance in the general area of contact when mallet strikes game piece; (c) how novel game can be played on suitable playing surface with minimal or no game area surface marking requirements.

The advantages offered by the invention are mainly that a set of low cost sliding discs is provided with an ideal range of balance of disc diameter, height, weight, and center of gravity location to render the disc stable and readily accessible for proper striking by a mallet with tapered head ends in game play. Furthermore, no detailed court layout or other markings are required for game play. However, general corner and other perimeters markers can be used to define a playing area if so desired. Game is intended primarily to be played on smooth ice, but other smooth and horizontal surfaces with low friction characteristics, such as concrete, asphalt, wood, tile, and terrazzo, can be used. Novel game play of invention offers competing players a safe, low cost, and challenging sport requiring a high degree of skill and strategy to be a consistant game winner.

BRIEF DESCRIPTION OF DRAWINGS

For further elucidation of the invention, some preferred embodiments thereof will now be described with reference to the accompanying drawings, in which.

DESCRIPTION OF PREFERRED EMBODIMENTS

A mallet driven sliding disc game according to the invention is played by two competing players, or by two pairs of competing players, on a smooth and horizontal low friction type surface such as ice. Game apparatus includes a set of five discs and at least one striking mallet, but preferably two mallets. No court layout or boundary markings are required, although formal or informal boundaries may be established if so desired. Game play requires a set of five discs, with distinguishing markings, such as different colors. Typical set, for example, has two blue discs, two yellow discs, and one red disc. Each competing side has a similarly colored pair of discs, and the odd, or red disc, is used as a common target disc in game play. Preferably, all discs of a set are identical in construction, although the target disc may differ somewhat from the other discs and be smaller in diameter if so desired. In general, all discs should have a desirably high diameter-to-height ratio and be constructed in such a manner to give them a low center of gravity to insure their stability in mallet-to-disc and disc-to-disc contact in game play. The main striking area of a disc is on the convex wall of the disc at approximate mid-height level of same. The striking mallet head end face should be sufficiently low in height to permit approximate center-to-center type contact between mallet face and convex disc wall at approximate mid-height level. A tapering mallet head design tends to satisfy this requirement, and in addition, the design renders a narrower lateral mallet face which facilitates better mallet strike of a disc in a difficult clearance situation where a number of other discs are close to the one to be struck.

Figure 1:
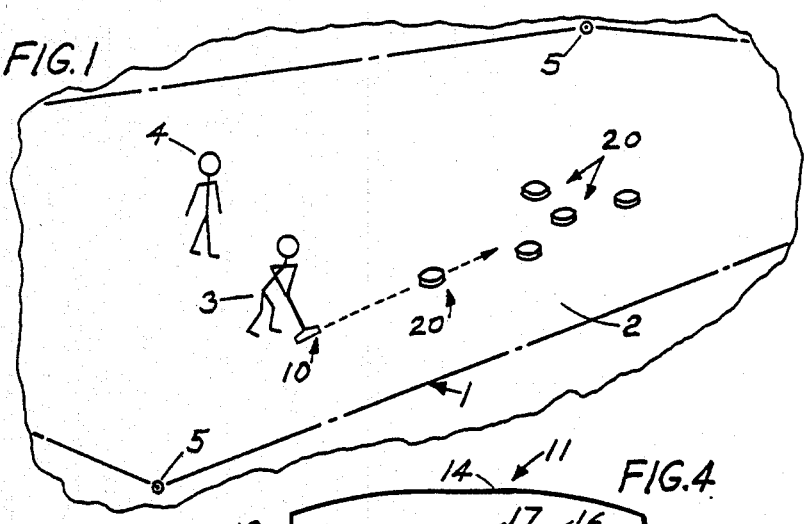
FIG. 1 is a perspective view of playing area showing stick figure players and game apparatus.
Figure 2:
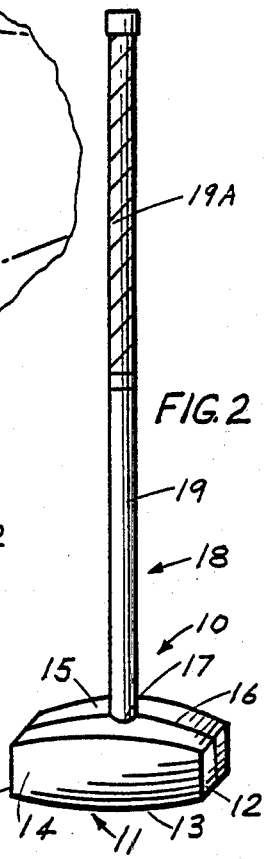
FIG. 2 is an oblique drawing of a striking mallet.
Figure 4:
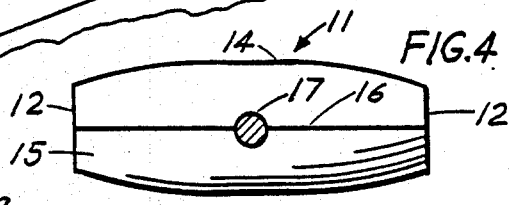
FIG. 4 is a top view of mallet head.
Figure 3:
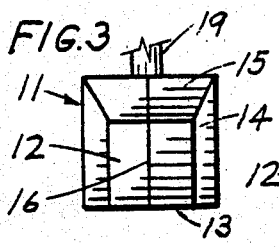
FIG. 3 is an end view of mallet head.
Figure 5:
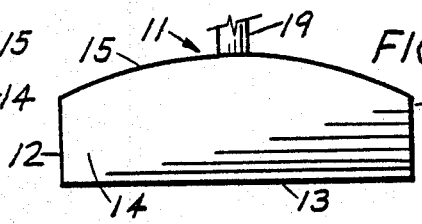
FIG. 5 is a side view of mallet head.

Referring now to the drawings, and particularly to FIG. 1, numeral 1 generally indicates the game playing area and optional boundary lines. Numeral 2 indicates the playing surface of ice or other suitable surface, and 3 and 4 represent competing players in stick form. Player 3 has just driven a game disc 20 with mallet 10 toward a group of four other discs. Corner marker 5 can be permanent or temporary type surface markers if optional boundary lines are used.

FIGS. 2–5 illustrate a striking mallet generally indicated by numeral 10, which comprises mallet head generally indicated by numeral 11 and handle means generally indicated by numeral 18. Mallet head is constructed using hardwood, with plastic or composition materials being optional. Numerals 12 indicate squared mallet end faces, 13 indicates flat mallet bottom surface, 14 indicates tapering mallet head side surfaces, and 15 indicates tapering mallet head top surface. A center guide line 16 marked across top of head surface 15 and extending vertically downward across head end faces 12, is used to line-up mallet, disc to be struck, and remote disc, and to indicate exact center of striking faces of mallet head. The flat bottom surface 13 of mallet head permits mallet to be set in an upright position without holding handle. Player can step back and line-up objective (disc) with center guide line 16 before making mallet strike. Numeral 17 indicates hole in mallet head to receive handle member 19 which has a gripping surface 19A.

Figure 6:
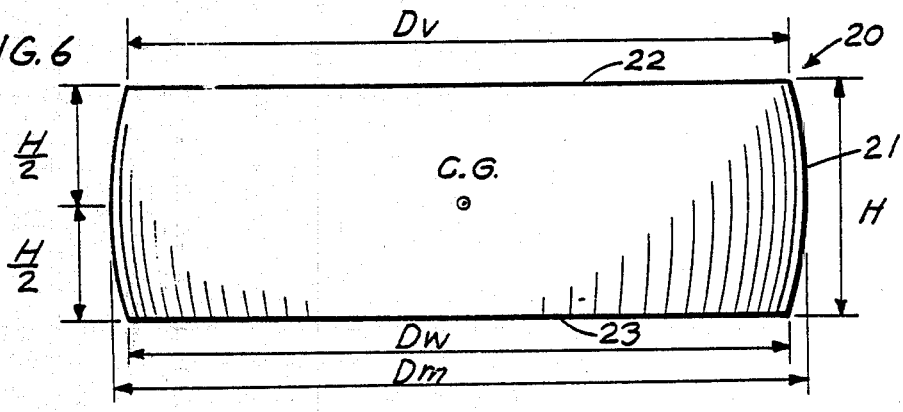
FIG. 6 is a side view of a solid disc body.
Figure 7:
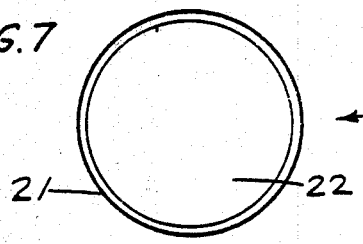
FIG. 7 is a top view of solid disc body of FIG. 6 on reduced scale.
Figure 8:
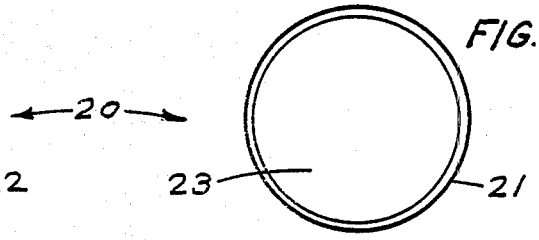
FIG. 8 is a bottom view of solid disc body of FIG. 6 on reduced scale.

FIGS. 6–8 illustrate a solid disc body generally indicated by numeral 20, with disc convex perimeter surface indicated by 21, disc top surface indicated by 22, and disc bottom surface indicated by 23. Disc body dimensions are represented by letters as follows: Dm is maximum disc diameter, essentially at mid point of disc height H; Dv is disc diameter at top surface; and Dw is disc diameter at bottom surface. The center of gravity of the solid disc body is indicated by C.G., and when Dv equals Dw, the C.G. is in the exact physical center of the disc body. Solid disc 20 is the simplest of the discs suggested in the invention, but its center of gravity is higher than desirable for best game play stability.

Figure 9:
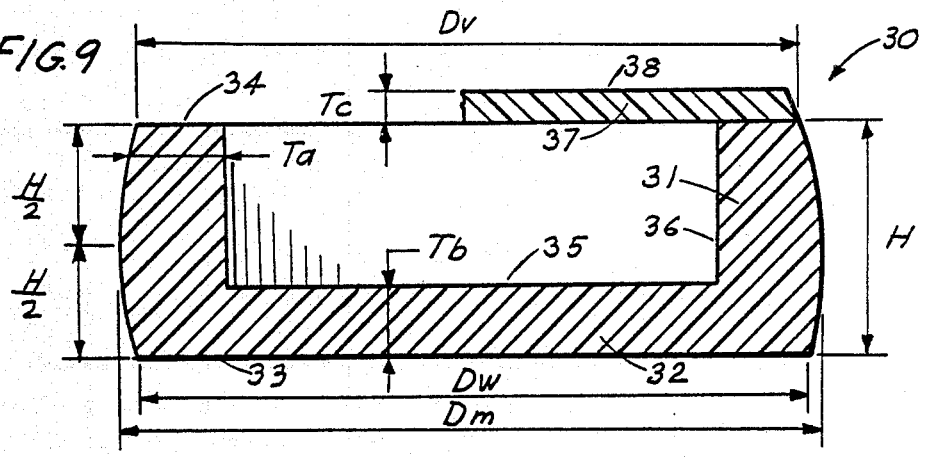
FIG. 9 is a sectional elevation view of bowl shaped disc body having cylindrical central cavity, with partial section of cavity lid.
Figure 10:
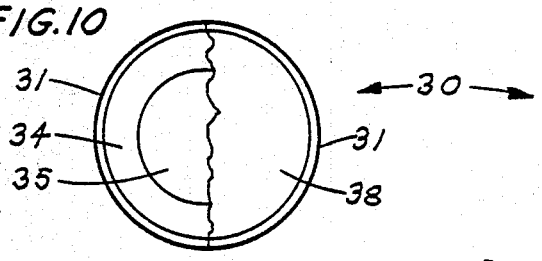
FIG. 10 is a top view of FIG. 9 on reduced scale with part of cavity lid removed.
Figure 11:
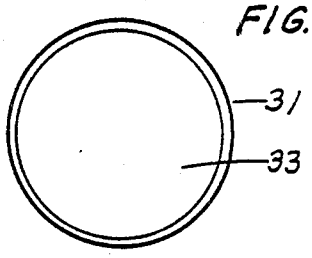
FIG. 11 is a bottom view of FIG. 9 on reduced scale.

FIGS. 9–11 illustrate a bowl shaped disc body having cylindrical central cavity and is generally indicated by numeral 30, with wall portion of disc body indicated by 31, bottom portion of disc body indicated by 32, bottom surface of disc body indicated by 33, top surface of disc body indicated by 34, interior bottom surface of cylindrical cavity indicated by 35, interior wall surface of cylindrical cavity indicated by 36, cavity lid, indicated by 37, is fastened to top surface of disc body 34. Top surface of cavity lid is indicated by 38. Lid 37 is optional, and can be fastened to disc body 34 in any suitable manner. Disc body and lid dimensions are represented by letters as follows: Dm is maximum diameter of disc body; Dv is disc diameter at top surface of disc body; Dw is disc diameter at bottom surface of disc body; H is disc body height; Ta is maximum wall thickness of disc body; Tb is bottom thickness of disc body; and Tc is thickness of optional cavity lid. Center of gravity of disc is below mid-height plane of disc, resulting in a more stable game piece as compared to solid body disc in FIG. 6.

Figure 12:
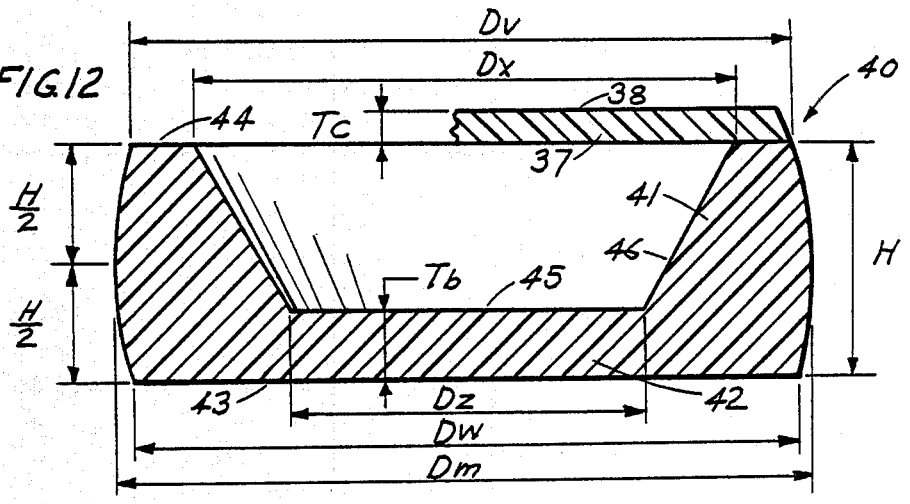
FIG. 12 is a sectional elevation view of bowl shaped disc body having conic type central cavity, with partial section of cavity led.
Figure 13:
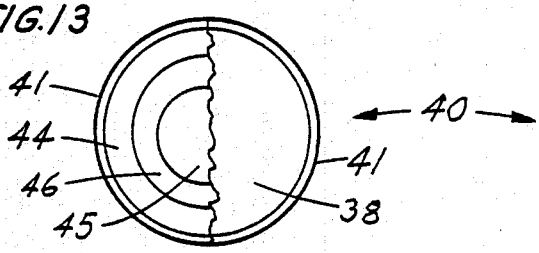
FIG. 13 is a top view of FIG. 12 on reduced scale with part of cavity lid removed.
Figure 14:
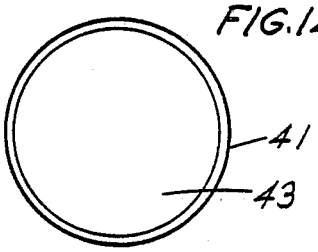
FIG. 14 is a bottom view of FIG. 12 on reduced scale.

FIGS. 12–14 illustrate a bowl shaped disc body having a conic section cavity and is generally indicated by numeral 40, with wall portion of disc body indicated by 41, bottom portion of disc body indicated by 42, bottom surface of disc body indicated by 43, top surface of disc body indicated by 44, interior bottom surface of conic section of disc body indicated by 45, interior wall surface of disc body indicated by 46, cavity lid, indicated by 37, is fastened to top surface of disc body 44. Top surface of cavity lid is indicated by 38. Lid 37 is optional, and can be fastened to disc body 44 in any suitable manner. Disc body and lid dimensions are represented by letters as follows: Dm is maximum diameter of disc body; Dv is disc diameter at top surface of disc body; Dw is disc diameter at bottom surface of disc body; H is disc body height; Dx is diameter of top interior surface of conic section of disc body; Dz is diameter of bottom interior wall surface of conic section of disc body; Tb is bottom thickness of disc body; and Tc is thickness of optional cavity lid. Center of gravity of disc is below mid-height plane of disc, resulting in a more stable game piece as compared to solid body disc of FIG. 6.

Referring to drawings and claims of invention, dimensions of a practical game disc such as that shown in FIG. 9, may be summarized in the following Table 1:

| Dim., Sign | Dim., Inch | Dim., Cms | Dim., Percent of Dm | |
|---|---|---|---|---|
| | | | Sample | Claims |
| — | — | — | | |
| Dm | 6 | 15.3 | 100 | — |
| Dv, Dw | 5½ | 14.0 | 92 | 80/100 |
| H | 2 | 5.1 | 33 | 25/50 |
| Tw | ½ | 1.27 | 8 | 5/30 |
| Tb | ⅜ | 0.95 | 6 | 2/20 |
| Tc | ⅛ | 0.31 | 2 | 1/10 |

Approximate material volume of above disc is 400 cc, and with lid added, it totals 445 cc, or slightly less than one pound weight if constructed material has a density of 1.00. The above practical game disc conforms to all dimension ranges as in claims. Center of gravity of disc is below the mid-height plane of disc.

For design of a disc with thicker walls, a construction material in the density range of 0.8 to 0.9 can be used and still keep disc weight under one pound (454 gms), a weight which is a practical upper limit for discs. Dimensions of a practical matching mallet for above disc would be 3×3 inches (7.6×7.6 cms) at central transverse cross section of mallet head, 2×2 inches (5.1×5.1 cms) at mallet head faces, 9 inches (22.9 cms) head length, and a mallet handle avout 1×30 inches (2.5×76 cms). It should be noted that matching disc and mallet faces have equal heights. Mallet head material can be hardwood, or optional dense plastic. Mallet handle is circular stock of any suitable material, with optional wrapping at gripping surface.

A brief description of game play of invention between two competing players is as follows. Assume each player has a mallet and a pair of discs. For example, one player has a pair of blue discs, and the other has a pair of yellow discs. A red disc is used as a common target disc. Assume game play on an ice rink. Determine starting player by toss of coin. Starter places target disc flat on ice and strikes it with mallet to any point on ice he so desires, but it should be at least one mallet handle length back from boundary line if present.

Starter then places one of his paired discs at starting spot and again makes strike with mallet, with the objective of his disc hitting target disc for a one point score and staying as close as possible to it. He can also try to shield target disc with his disc. Opponent then places his first paired disc on starting spot and hits it and tries to hit target disc and/or starter's disc with his disc for point scores. Starter next plays his last disc with same objectives but must avoid hitting his first disc direct to avoid a negative point score. He can, however, hit target disc and/or opponent's disc first and then carom to his own disc for a multiple point score. Opponent then plays his last disc with same objectives. Positioning of player discs in respect to target disc is very important since score points are awarded for the two closest player discs to target disc at the end of each of the two short rounds in one game. Players have now completed first round of play. Closeness and contact points are totalled and recorded. Discs are left in their resting positions and second round of play begins. Player with disc farthest from target disc starts second round play, with same objectives as before, but usually in second round, discs are close together and playing strategy becomes very important. Players proceed to end of round and game with alternating strikes of their discs as in first round. Again closeness and contact points are totalled and recorded.

Play of second game starts where first game ended. Opponent of first game starter, starts second game. Game play thereafter is same as in first game. Placement of target disc alternates between players as game play proceeds. Each game takes about five minutes. Player with more points wins game. Player with more game wins is match winner. A match of about 20 games is typical. A summary of score count rules is: For 1 point, (a) struck disc hits target disc or opponent's disc; (b) any disc hits target disc, or is hit by target disc; (c) disc that is second closest to target disc at end of each round. For 2 points, (a) struck disc hits opponent's disc and then hits target disc or visa versa; (b) striker's disc hits opponent's disc or target disc and then hits his own disc; (c) disc that is closest to target disc at end of each round. For −1 point, (a) Player's struck disc hits his other disc direct. Game rules are made to cover every playing situation but space does not allow further details here. For doubles play, team players alternate strikes. Certain forms of tie-breakers in game play are employed when necessary. An alternate method of determining match winner is to total game points, with player or team having more points being declared match winner. A bonus feature in game rules provides that if a side fails to score a net positive point score in a game, the winning side is awarded a double game win or a double point score as a bonus.

While the invention has been described in conjunction with preferred specific embodiments thereof, it will be understood that this description is intended to illustrate the invention which is defined by the claims attached hereto.

I claim:

1. Mallet driven sliding disc game and apparatus therefor, wherein the apparatus comprises a smooth and horizontal playing surface means, said playing surface means including a game area means, at least one striking mallet, and a set of five sliding game pieces of resilient material being circular discs with maximum diameter of about 4 inches (10.2 cms) to about 7 inches (17.7 cms), with two of said five pieces having first type distinguishing markings, two others of five said pieces having second type distinguishing markings, and remaining one of five said pieces having a third type distinguishing marking, said mallet comprises a handle member having a gripping surface means at one end and is secured perpendicularly to the top central portion of an elongated head member at its other end, said head member being essentially rectangular in cross section normal to the nominal longitudinal axis at the central portion of said head member, with top and side surfaces of said head member tapering gradually downwardly and inwardly respectively while moving toward the faces at each end of said head member, said faces being essentially rectangular in shape and positioned normal to the nominal longitudinal axis of said head member, bottom surface of said head member being flat, whereby players competing in a prescribed manner, on said playing surface means, drive said game pieces with said mallet to position said game pieces for game advantage and to make maximum contact and proximity point scores in attempt to win game.

2. Mallet driven sliding disc game and apparatus according to claim 1 wherein said head member of said mallet has: (a) a length of about 6" (15.2 cms) to about 10" (25.4 cms); (b) a said cross sectional size at central portion of about 2" (5.1 cms) to 4" (10.2 cms) by 2" (5.1 cms) to 4" (10.2 cms); and (c) a said cross sectional size at both end faces of about 1½" (3.8 cms) to 2½" (6.3 cms) by 1½" (3.8 cms) to 2½" (6.3 cms).

3. Mallet driven sliding disc game and apparatus according to claim 1 wherein each of said game pieces has a solid circular disc body symmetrical about a central axis perpendicular to and extending from the lowermost surface of said body to the uppermost surface of said body, said body having its maximum diameter where a plane parallel to and midway from the uppermost and lowermost surfaces of said body intersects the circumferential wall of said body, height of said body being about 25 to 50 percent of said maximum diameter of said body, and uppermost and lowermost surface diameters of said body being about 80 to 100 percent of said maximum diameter of said body.

4. Mallet driven sliding disc game and apparatus according to claim 1 wherein each of said game pieces has a circular disc body, wherein central portion of said body has the shape of an upwardly open bowl with cylindrical interior wall surface, said body being symmetrical about a central axis perpendicular to and extending from the lowermost surface of said body to the uppermost surface of said body, said body having its maximum diameter where a plane parallel to and midway from uppermost and lowermost surfaces of said body intersects the outer circumferential wall of said body, height of said body being about 25 to 50 percent of maximum diameter of said body, diameters of both the uppermost and lowermost outer wall portions of said body being about 80 to 100 percent of said maximum diameter of said body, maximum thickness of wall between outer surface and cylindrical interior surface of said body being about 5 to 30 percent of maximum diameter of said body, thickness of bottom of said bowl-shaped central protion of said body, as measured from the bottom interior surface of said bowl-shaped central portion of said body to the lowermost surface of said body being about 2 to 20 percent of maximum diameter of said body.

5. Mallet driven sliding disc game and apparatus according to claim 4 wherein said body has a circular lid attached to uppermost surface of said body, diameter of said lid being essentially the same as the diameter of uppermost outer wall portion of said body, and thickness of said lid being about 1 to 10 percent of maximum diameter of said body.

6. Mallet driven sliding disc game and apparatus according to claim 1 wherein each of said game pieces has a circular disc body, wherein central portion of said body has the shape of an upwardly open bowl with interior surface being in the form of a frustum of a cone with larger diameter of said conic section being at top of said disc body, and said conic section being symmetrical about a central axis perpendicular to and extending from the lowermost surface of said body to the uppermost surface of said body, said body having its maximum diameter where a plane parallel to and midway from the uppermost and lowermost surfaces of said body intersects the circumferential outer wall of said body, height of said body being about 25 to 50 percent of maximum diameter of said body, diameters of both the uppermost and lowermost outer wall portions of said body being about 80 to 100 percent of maximum diameter of said body, diameter of uppermost interior wall surface of said bowl-shaped central portion of said body being 40 to 80 percent of maximum diameter of said body, diameter of lowermost interior wall surface of bowl-shaped central portion of said body being 0 to 40 percent of maximum diameter of said body, and thickness of the bottom of said bowl-shaped portion of said body, as measured from the bottom interior surface of said bowl-shaped central portion of said body to lowermost surface of said body being about 2 to 20 percent of maximum diameter of said body.

7. Mallet driven sliding disc game and apparatus according to claim 6 wherein said body has a circular lid attached to uppermost surface of said body, diameter of said lid being essentially the same as the diameter of the uppermost outer wall portion of said body, and thickness of said lid being about 1 to 10 percent of maximum diameter of said body

8. Mallet driven sliding disc game and apparatus according to claim 1 wherein said head member of said mallet has: (a) a length of about 6 to 10 inches (15.2 to 25.4 cms); (b) a cross sectional size at central portion of about 2 to 4 inches (5.1 to 10.2 cms) by 2 to 4 inches (5.1 to 10.2 cms); (c) a cross sectional size at both faces of about 1½ to 2½ inches (3.8 to 6.3 cms) by 1½ to 2½ inches (3.8 to 6.3 cms); and (d) a center guide line means passing longitudinally across the top surface of said head member and extending down vertically across both end faces of said head member.

9. Mallet driven sliding disc game and apparatus according to claim 1 wherein said game area means is determined on said playing surface means by establishing corner or other perimeter markers to form a rectangular playing area of at least 500 square feet (46.0 sq. mts), with neither dimension of said rectangular playing area being less than 15 feet (4.5 mts).

10. Mallet driven sliding disc game and apparatus according to claim 1 wherein said playing surface means is ice, and said playing area means is determined by the existing perimeter of a rink, such as that used for indoor or outdoor winter sports.

* * * * *